United States Patent [19]

Bretl et al.

[11] Patent Number: 4,866,958

[45] Date of Patent: Sep. 19, 1989

[54] PUSH-BUTTON LOCK MECHANISMS

[75] Inventors: Robert J. Bretl, Menominee, Mich.; Jewell A. Taylor, Salinas, Calif.

[73] Assignee: Lock-R-Lock, Salinas, Calif.

[21] Appl. No.: 237,509

[22] Filed: Aug. 26, 1988

[51] Int. Cl.[4] ..... E05B 37/18

[52] U.S. Cl. ..... 70/25; 70/306; 70/313; 70/323

[58] Field of Search ..... 70/25, 26, 22, 21, 20, 70/287, 288, 301, 304, 306, 312, 313, 323

[56] References Cited

U.S. PATENT DOCUMENTS

| | | | |
|---|---|---|---|
| 3,357,216 | 12/1967 | Cook | 70/313 |
| 4,196,603 | 4/1980 | Malacheski | 70/313 |
| 4,794,768 | 1/1989 | Moser | 70/306 |

*Primary Examiner*—Robert L. Wolfe

*Attorney, Agent, or Firm*—Michael Kovac

[57] ABSTRACT

A sequence dependent push-button lock mechanism having compression loaded locking rod assemblies, arcuate segments of which are placed in compression if attempts are made to force the lock open, and unlocking by rotating the arcuate segments out of compression engagement with a sliding block associated with a thumb-actuated reciprocating shackle sleeve, particularly adapted for use in padlocks and deadbolt/cabinet locks. The locks are applicable to use in combination with pivot-only shackles in the padlock form, and thumb-actuated shackle or deadbolt release mechanisms. The thumb latch is of a break-away type to deter plurality of holes in a spaced array for receiving spring biased automatic return push-button assemblies which actuate locking rods that are disposed to rotate upon selective engagement with various combinations of special "T" and "C" shaped flanges on button actuator members. The permutations of T and C flanges, actuating from 2 to 6 locking rods, offers a large number of possible lock combinations. The lock mechanism may optionally include an extra re-lock push-button for actuating a re-lock bar that simultaneously resets all the locking rods to the locked position by acting on the lower canted end. An optional auxiliary master key is also provided that, upon turning, imparts a auxiliary master key is also provided that, upon turning, imparts a rotation to all the locking rods permitting the lock to be opened. Compression loading the locking rods to prevent opening provides a very high strength lock mechanism of simple construction and assembly. Simple modification of the actuators provides a non-sequence dependent lock, if desired.

54 Claims, 5 Drawing Sheets

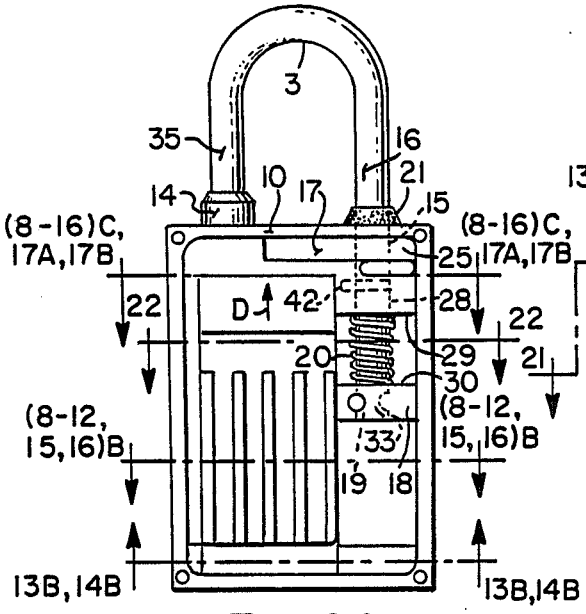
Fig_2A
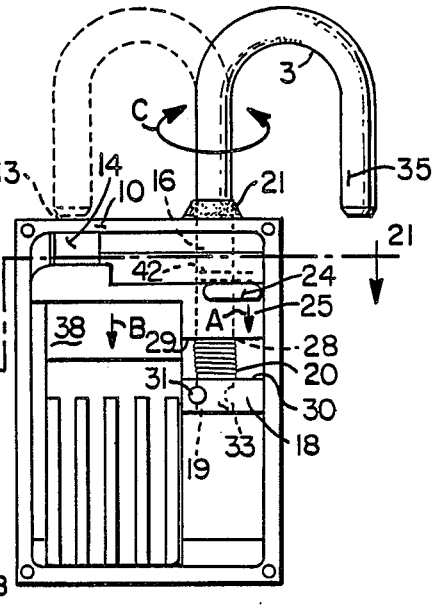
Fig_2B
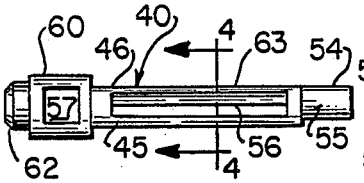
Fig_3
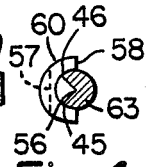
Fig_4
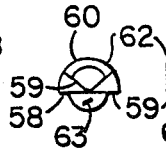
Fig_6
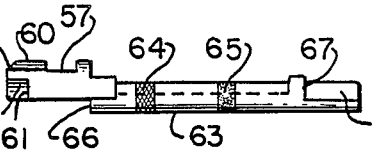
Fig_5
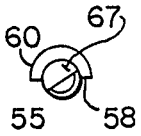
Fig_7
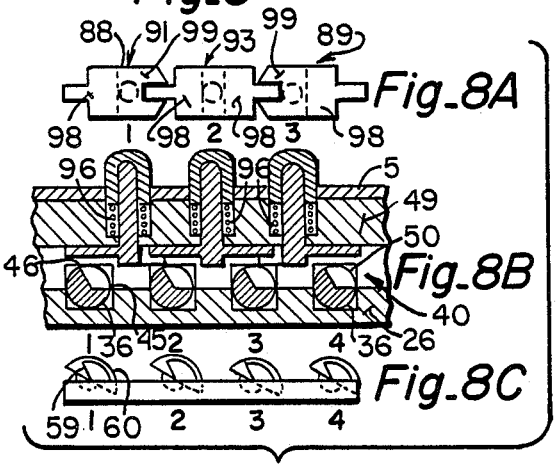
Fig_8A
Fig_8B
Fig_8C
Fig_8
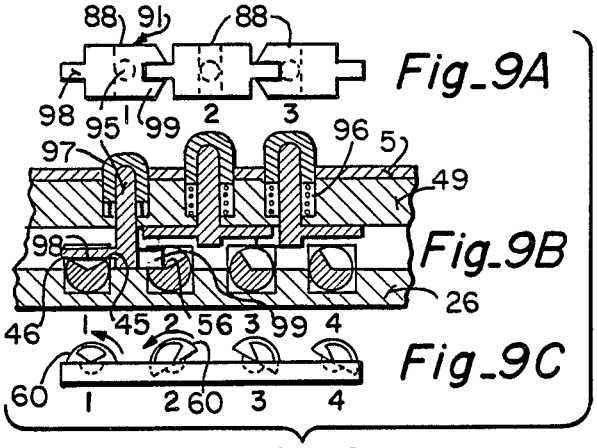
Fig_9A
Fig_9B
Fig_9C
Fig_9
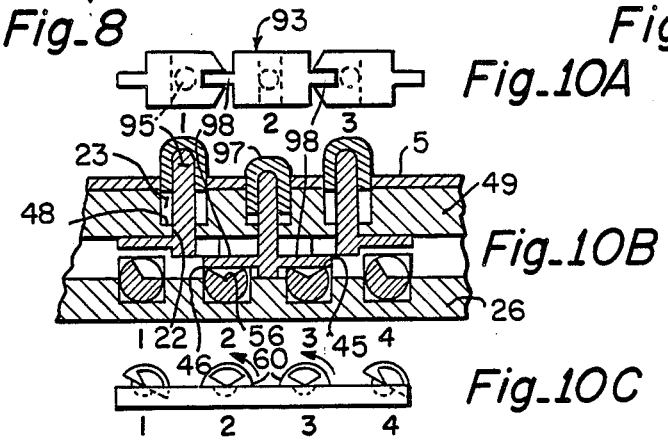
Fig_10A
Fig_10B
Fig_10C
Fig_10

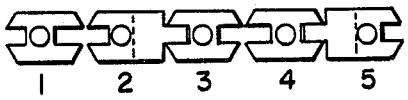
Fig_16A
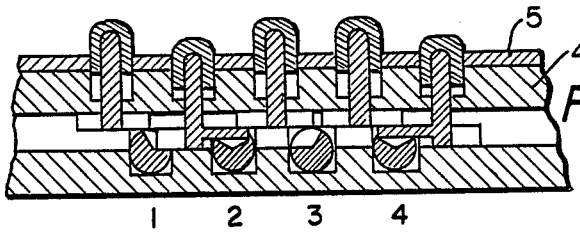
Fig_16B
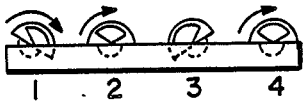
Fig_16C
Fig_16
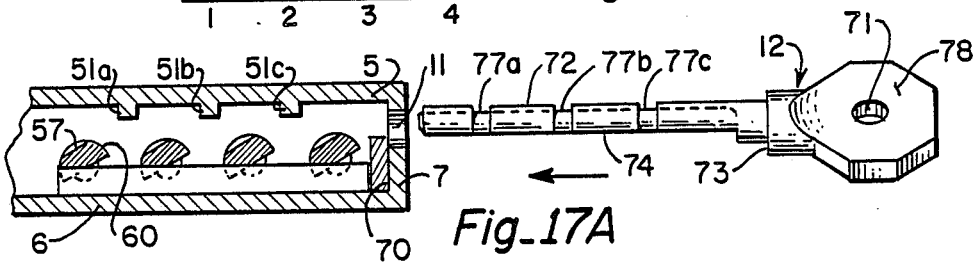
Fig_17A
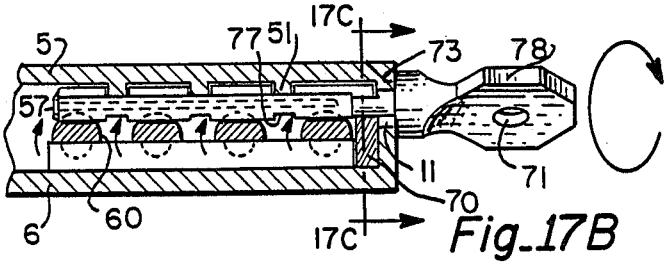
Fig_17B
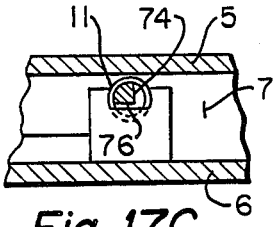
Fig_17C
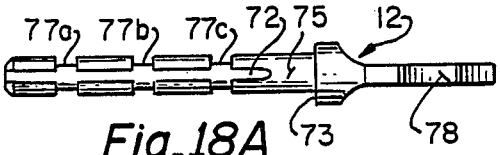
Fig_18A
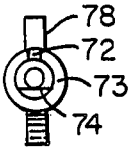
Fig_18D
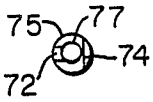
Fig_18E
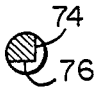
Fig_18F
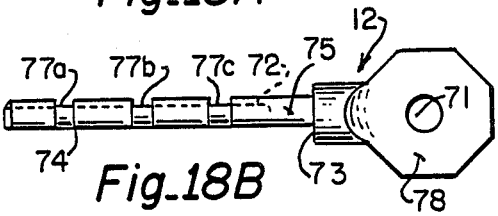
Fig_18B
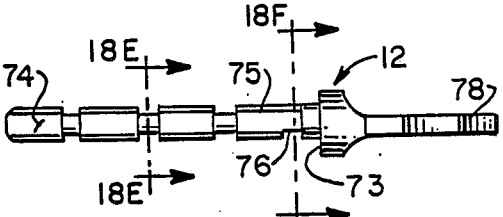
Fig_18C
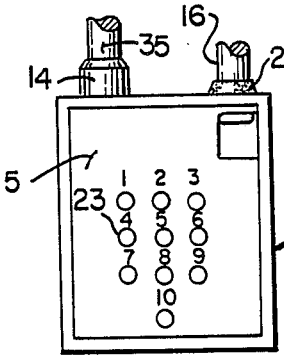
Fig_19
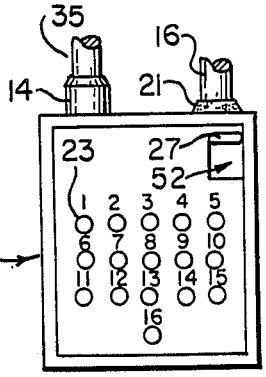
Fig_20

PUSH-BUTTON LOCK MECHANISMS

RELATED APPLICATION

This application in part discloses swivel-only shackle assemblies for padlocks in combination with the novel locking mechanisms of this invention characterized by locking rods under compression. Swivel only shackle feature are disclosed and claimed in our co-pending application Ser. No. 220,586, filed July 18, 1988, entitled PUSH BUTTON PADLOCKS HAVING SWIVEL-ONLY SHACKLES, the disclosure of which is hereby incorporated by reference.

FIELD

The invention relates to locks having selectively rotatable locking rod assemblies characterzed by locking rods under compression to prevent opening having particular use in padlocks and deadbolt type locks. In padlocks, the locks of this invention are also characterized by having shackles which only pivot, rather than reciprocate, to open. More particularly, the invention relates to pad and deadbolt type locks having a special reboundtype push-button actuated rotating rod locking assembly which may be used in combination with pivot-only shackles in the padlock form, and thumb-actuated shackle or deadbolt release mechanisms. The locks of this invention have the advantages of being easy to open, especially by visually impaired or handicapped persons or in the dark, of offering a high number of combination possibilities, and high strength.

BACKGROUND

It has been known in the prior art of exposed shackle padlocks to provide shackle assemblies for which a reciprocating movement between the shackle and the lock housing is required to open the padlock. The most common form of these padlocks comprises a relatively complex arrangement of locking members to latch and release the shackle relative to the padlock body. These padlocks have an inverted J-shaped shackle that when released, moves upwardly out of the body to achieve relative reciprocal movement. The short end of the shackle will then pivot to open only after vertically clearing the padlock body, and the long end is entrained in the locking mechanism. These type of padlocks are generally called reciprocating shackle padlocks.

Another variation on this theme of relative reciprocal movement between the shackle and the padlock body is a reversal of parts as shown in Atkinson, U.S. Pat No. 3,837,189 issued Sept. 24, 1974. The Atkinson design padlock comprises an inverted U-shaped shackle with one end fractionally shorter than the other, and a lock body having an outer shell and an inner core which are adapted to move a constrained amount relative to each other. When the locking mechanism is actuated to an "open" position, the shorter end of the shackle is released by downward movement of the outer shell. This permits the shackle to pivot open.

One serious problem with reciprocating padlocks is that internal space limitations do not provide a sufficiently deep recess for the free end of the shackle. Due to the inherent play in the lock mechanism in securing the entrained end of the shackle, the shackle often can be pulled out a sufficient distance to clear the upper end of the padlock body to be pivoted open. There is nothing to prevent the shackle from pivoting once it clears the upper surface of the padlock body. The force necessary to open some padlocks is as little as 140 lbs; many high school-age young men can pull open such locks easily by hand.

Another disadvantage of many current padlocks is the use of rotary dials. Rotary dials can not be used in the dark or by many handicapped or visually impaired people. Often, dexterous fully-sighted persons have difficulty opening such locks, even in daylight. In addition, rotary dial operation is slow and requires relative precision of alignment of the dial markings with the index, and the settings are imprecise in all but the most expensive locks.

There are also disadvantages with the use of key locks. Keys are an inconvenience to carry around and can be easily lost or stolen. Most people would prefer to keep a combination in their head rather than to add another key to their key ring.

Push-button locks, such as Cheng, U.S. Pat. No. 4,751,830, issued June 21, 1988, have significant advantages over rotary dial and key locks. The positive action of a push-button lock allows for quick, easy and accurate operation. They offer the relative pick-resistance of combination locks, and also can be opened in the dark, or by sightless, visually impaired or physically handicapped persons.

One disadvantage with current push-button padlocks is the amount of internal parts required which results in a padlock that is complex to assemble. Another disadvantage is that some reciprocating shackle push-button padlocks are susceptible to being opened by a small prying forces as a result of the inherent amount of play in an exposed shackle, reciprocating padlock. Still another disadvantage with some push-button padlocks is that the buttons, as in Cheng, pass completely through the locks and do not reset themselves. Thus the combination can be observed while open, and care must be taken by the user to push all the buttons one way or the other (all to the front or all to the back) so as to disguise the combination and relock the lock. Further, such nonauto reset (relock) locks are not adaptable to deadbolt or cabinet lock usage, as the rear of the lock must be exposed for manual resetting of the buttons. In a deadbolt or cabinet type (mounted or inset) lock, the lock is mounted with the back inset, flush or abutting a carrying member, such as a door, door jamb, frame, casing or the like, and accordingly is not accessible for resetting the buttons. While some push button combination locks, particularly door locks, are available, they are typically very expensive or complex electronic locks dependent on fallible electric power.

Accordingly, there is a need in the art for a strong, autoreset push-button lock that is easy to operate, inexpensive to assemble, has a simplicity that does not yield excessive play permitting opening by a small prying force, and is equally adaptable to use either in a padlock or deadbolt form.

THE INVENTION

OBJECTS:

It is among the objects of this invention to provide a locking mechanism in which locking is accomplished by placing arcuate segments of rotatable locking rod members in compression, and unlocking by rotating the arcuate segments out of compressive engagement with a sliding block.

It is another object of this invention to provide special load-bearing locking rods as part of the locking mechanism to significantly increase the overall strength of the lock.

It is another object of this invention to provide an improved, auto-relock push-button locking assembly, which is simple to manufacture and assemble and provides for easy selection of a wide variety of combinations involving either single or multiple buttons.

It is another object of this invention to provide an improved push-button locking mechanism which may be used with auxiliary master key mechanisms.

It is another object of this invention to provide two types or special actuators as part of the push-button assemblies, a T actuator, and a C actuator that act alone or in combination on a set of locking mechanism rods within the lock in order to open the lock and which provide sequence dependent opening combination features.

It is another object of this invention to provide special push-buttons of four varieties being composed of all the permutation of the actuators, two types of flanges, a T-C button, a C-T button, an H button and a double T button, particularly adapted for use in push-button locking mechanisms.

It is another object of this invention to provide a special relock button particularly adapted to reset all the locking rods and thereby relock the locking mechanism for use in push-button locking mechanisms.

It is another object of this invention to provide an improved push-button locking mechanism comprising a simple button block having common push-button holes therein for receiving a plurality of different types of button assemblies resulting in a wide range of possible combinations and permutations, which buttons are spring-biased–within the button block to provide an auto-rebound property.

It is another object of this invention to provide the auto-rebound, single-button auto relock, reciprocating latch/sleeve, push-button, pivoting locking rod lock mechanisms of this invention adapted for use in padlock, deadbolt and cabinet-type locks.

Still other objects will be evident from the summary, detailed description, drawings, abstract and claims which follow.

SUMMARY:

The invention is described in most detail in its preferred adaptation as a push-button padlock, but it is clear from the detailed description below that it is equally applicable to deadbolt, cabinet, door and other types of locks. In its preferred form the invention comprises in operative combination a push-button padlock having a housing, an inverted, generally J-shaped shackle, a reciprocable shackle latching assembly including a thumb latch and a hardened sleeve, and a locking mechanism located in the housing actuated by the push-buttons projecting through one wall thereof. The shackle is adapted to only pivot, called a swivel-only shackle, the free end of which is receivingly engaged by the sleeve. In turn the sleeve is reciprocable into the padlock housing upon actuation of a thumb latch member projecting through the housing, preferably through a hole in the front face. The inverted J-shaped shackle has its longer end entrained in the padlock body wherein it engages a latching mechanism which includes the thumb latch and shackle sleeve members. The thumb latch is preferably of breakaway construction and the sleeve may be rotatable. A locking mechanism of any desired type to selectively lock and unlock the latching mechanism may be employed.

The preferred locking mechanism is of a push-button type, and comprises a button block member secured to the inside of the housing face plate and having a plurality of holes in a spaced array for receiving up to five types of button assemblies, four types of which are combination actuating and a fifth type which serves to relock the locking mechanism. The button block includes a plurality of relatively wide cross grooves, oriented to form both transverse and longitudinally-oriented, parallel channels forming the top half of square-sectioned tubes in which special locking rod members lay.

The push-button assembly comprises a flat plate with four parallel channels oriented longitudinally along the plate, intersected perpendicularly by a single wider channel at the upper end of the four parallel channels. Four rods are then disposed in the four parallel channels with the head of each rod resting in the wider transverse channel. The four channels in the push-button assembly are disposed coordinate with the longitudinal channels in the button block (secured to the underside of the face plate).

The button block has a series of holes to accept the various types of spring-biased buttons. The buttons have different actuator configurations which rotate two of the rods beneath them to one of three positions when depressed. The rotation of the rods correspondingly rotates the heads; upon the desired rotation of all of the heads, the flat plate is permitted to reciprocate downward by actuation of the thumb latch assembly. Typically, each rod may be rotated by several buttons. Successfully turning one rod to the unlocked position does not insure that a subsequently depressed button will not further rotate the rod to an undesired (relocking) position. Therefore, the push-button combination is sequence dependent, which further adds to the difficulty of chancing upon the combination of the lock. The locking rod heads resist tremendous loads in compression making this type of push-button locking mechanism as strong as high security type key locks.

In addition to the combination push-buttons, a single relock button (auto relock), having a base configuration of a long flat bar, engages the canted tail end portions of the rods and rotates all the heads to a relock position upon depression.

The detailed description of the invention includes a 10 pushbutton combination lock, and an alternative 16 push-button combination with a master key override. The extra buttons of the 16 push-button combination lock add a greater possible number of combinations. The master key is inserted through a hole in the side of the housing and manually rotates the heads of the rods to the open position so that the release (unlatching) mechanism can be actuated. Also included in the detailed description of the invention is an alternate embodiment of the lock mechanism in the form of a dead bolt or cabinet-type lock.

BRIEF DESCRIPTION OF THE DRAWINGS

The principals of the invention are disclosed in the drawing in which:

FIG. 2A is a front elevation with the face plate removed showing the internal mechanism of the lock in the locked position;

FIG. 2B shows a front elevation view of the lock of this invention with the face plate removed in the unlocked position illustrating the reciprocating action of the thumb latch assembly and the swivel action of the shackle;

FIG. 3 is a top elevation view of a locking rod member;

FIG. 4 is a transverse section view taken along line 4-4 of FIG. 3 which shows the V-groove and its orientation relative to the locking rod head;

FIG. 5 is a side elevation view of the locking rod member showing two alternative methods for providing a friction surface to the center and portion;

FIG. 6 is a left end view of the locking rod member of FIG. 5 which shows the locking rod head and the relative orientation of the pie-slice relieved portions to the locking rod head flat;

FIG. 7 is right end view FIG. 4 which shows the relative orientation of the canted end relock flat to the locking rod head and locking rod head flat;

FIGS. 8-12, 15 and 16 are three part comparative views of one row of a push-button configuration which shows the functioning of the push-button assemblies acting on the locking rod members and the rotation of the corresponding locking rod heads from the locked to the unlocked and relock positions;

FIGS. 8-12 relate to a 4, 7, 10, 13 or 16 push-button configuration with push-button assemblies 1-3 acting on rod members 1-4, while FIGS. 15 and 16 relate to a 6, 11, 16 or 21 [$T=(r \cdot n)+1$; where $r=5$] push-button configuration with push-button assemblies 1-5 acting on rod members 1-4; FIGS. 8A, 9A and 10A are identical illustrations of the bottom view of the 2nd position double T button actuator, disposed between the 1st position T-C button actuator and the 3rd position C-T button actuator;

FIG. 8B is a transverse section view taken along line 8B—8B of FIG. 2A with the addition of the face plate and locking rod members showing all the locking rod members in the locked position and all three push-buttons of FIGS. 8A, 9A and 10A in the un-depressed position;

FIG. 8C is a transverse elevation end view taken along line 8C—8C of FIG. 2A of the locking rod members showing them all in the locked position;

FIG. 9B is a transverse section view taken along line 9B—9B of FIG. 2A with the addition of the face plate and the locking rod members showing the interaction of the 1st position T-C button actuator depressed and its rotation of 1st and 2nd position locking rod members;

FIG. 9C is a transverse elevation end view taken along line 9C—9C in FIG. 2A of the locking rod members where the 1st position locking rod head member is rotated to its unlocked position and the 2nd position locking rod head member is rotated from a first locked position to a second, relock position;

FIG. 10B is a transverse section view taken along line 10B—10B of FIG. 2A with the addition of the face-plate and the locking rod members showing the interaction of a depressed 2nd position double T button and the affected 2nd and 3rd position locking rod members;

FIG. 10C is a transverse elevation end view taken along line 10C—10C in FIG. 2A of the locking rod members where the only 2nd and 3rd position locking rod heads are rotated to their unlocked positions;

FIGS. 11A and 12A are identical illustrations of the bottom of a 2nd position H button disposed between a 1st position C-T button and 3rd position T-C button;

FIG. 11B is a transverse section view taken along line 11B—11B 11B in FIG. 2A with the addition of the face plate and the locking rod members showing the 2nd position H button actuator depressed and acting on the 2nd and 3rd position locking rod members whereby the 2nd position locking rod member is held into the locked position and the 3rd position locking rod member is rotated to the relock position;

FIG. 11C is a transverse elevation end view taken along line 11C-11C in FIG. 2A of the locking rod members showing the corresponding view to 11B where the 2nd position locking rod head being unaffected while the 3rd position locking rod head is rotated to the relock position;

FIG. 12B is a transverse section view taken along line 12B—12B in FIG. 2A with the addition of the face plate and the locking rod members showing all four locking rod members being acted upon by the simultaneous or sequential depression of 1st position C-T button and 3rd position T-C button actuators;

FIG. 12C is a transverse elevation end view taken along line 12C—12C in FIG. 2A of the locking rod members showing the 1st position locking rod head being unaffected and remaining in the locked position, the 2nd and 3rd position locking rod heads rotated to the unlocked position, and the 4th position locking rod head rotated to a relock position;

FIGS. 13 and 14 are comparative illustrations showing the functioning of the relock (reset) button to act simultaneously on all of the locking rod members and rotate the locking rod heads to the relock position;

FIGS. 13A and 14A are identical illustrations of the bottom view of the relock button actuator;

FIG. 13B is a transverse section view taken along line 13B—13B of FIG. 2B with the addition of the face plate and the locking rod members showing all locking rod canted end relock flats in the unlocked position;

FIG. 13C is a transverse elevation end view taken along line 13C—13C of FIG. 2A showing the corresponding view to FIG. 13B where all locking rod heads are in the unlocked position;

FIG. 14B is a transverse section view taken along line 14B—14B in FIG. 2B with the addition of the face plate and the locking rod members showing all canted end relock flats being acted upon simultaneously by the depressed relock button;

FIG. 14C is a transverse elevation end view taken along line 14C—14C of FIG. 2A showing the corresponding view to FIG. 14B where all locking rod heads are rotated to the relock position;

FIGS. 15 and 16 are three-part comparative views of three-row, five column push-button configuration, in this case 16 pushbuttons, which shows the functioning of the push-buttons numbered 1-5 acting on the locking rod members numbered 1-4 and the rotation of the corresponding locking rod heads from the relock to the unlocked and locked positions;

FIGS. 15A and 16A are identical illustrations of a bottom view of a series of five push-buttons comprising a 1st position H button actuator, a 2nd position C-T button actuator, a 3rd position H button actuator, a 4th position H button actuator and a 5th position T-C button actuator;

FIG. 15B is a transverse section view taken along line 15B—15B of FIG. 2A with the addition of the face plate and the locking rod members showing all four locking rod members in the locked position and all five pushbuttons of FIGS. 15A and 16A in the undepressed position;

FIG. 15C is a transverse elevation end view taken along line 15C—15C of FIG. 2A showing the corresponding view to FIG. 15B where the locking rod heads are in the locked position;

FIG. 16B is a transverse section view taken along line 16B—16B in FIG. 2A with the addition of the face plate and the locking rod members showing the 1st, 2nd and 4th position locking rod members being acted upon by the depressed 2nd position C-T and 5th position T-C buttons actuators;

FIG. 16C is a transverse elevation end view taken along line 16C—16C in FIG. 2A showing the corresponding view to FIG. 16B where the 1st position locking rod head is rotated to the locked position and the 2nd and 4th position locking rod heads are rotated to the unlocked position;

FIGS. 17A and 17B are a pair of comparative views showing the functioning of the auxiliary (master) key guide pins in the padlock and corresponding circular clearance grooves on the key to insert the key and unlock the lock;

FIG. 17A is a is a transverse section view taken along line 17A—17A in FIG. 2A showing all the locking rod heads in the relock position and the key external to the padlock housing;

FIG. 17B is a transverse section view taken along line 17B—17B in FIG. 2A showing the inserted and rotated key and the locking rod heads rotated to the unlocked position;

FIG. 17C is a partial cross section taken along line 17C—17C in FIG. 17B showing the key journal block, the key hole, and the key inserted therein;

FIGS. 18A–18F are comparative views of the master (auxiliary) key showing the dimensions and location of the pin guide (longitudinal clearance) groove, circular clearance grooves and the cam stop along the key;

FIG. 18A is a top plan view of the key which shows the guide pin groove along the longitudinal axis of the key shaft and the three evenly; spaced circular clearance grooves disposed transverse to the longitudinal clearance groove;

FIG. 18B is a side elevation view of the key which shows the longitudinal clearance groove in dashed lines along the top of the key shaft;

FIG. 18C is the identical side elevation view of FIG. 18B rotated ¼ turn into the face of the page showing the notch-cut cam stop at the key head end of the key shaft;

FIG. 18D is an end view of the key looking down the key shaft toward the direction of the key head which shows the longitudinal clearance groove and the key guide flat;

FIG. 18E is a section view through line 18E—18E in FIG. 18C which shows the longitudinal clearance groove and the reduced radius of the key shaft created by the circular clearance groove;

FIG. 18F is a section view through 18F—18F in FIG. 18C showing cam stop;

FIG. 19 is a front elevation view of the padlock face showing the thumb latch and a typical three in a row push-button configuration in this case a 10 push-button configuration;

FIG. 20 is a front elevation view of the padlock face showing the thumb latch and a typical five in a row push-button configuration;

DETAILED DESCRIPTION OF THE BEST MODE OF THE INVENTION:

The following detailed description illustrates the invention by way of examples, and not by way of limitation, of the principles of the invention. This description will clearly enable one skilled in the art to make and use the invention, and describes several embodiments, adaptations, variations, alternatives and uses of the invention, including what we presently believe is the best mode of carrying out the invention.

In the detailed description below FIGS. 1–3, and 19–21 show the lock mechanism of FIGS. 1, 3–18, 22 and 23 applied and adapted to a padlock, particularly a swivel-only shackle type padlock. This type padlock is shown and disclosed with a different internal locking mechanism in our co-pending application Ser. No. 220,586 filed July 18, 1988, entitled PUSH-BUTTON PADLOCKS HAVING SWIVEL-ONLY SHACKLES, the disclosure of which is incorporated herein by reference to the extent needed. It should be understood that the locking mechanism of this invention may be used in a wide variety of lock types, regardless of trade designation, such as deadbolt locks, cabinet locks, and the like. An example of application to deadbolt and cabinet locks is disclosed in FIGS. 24–26 herein. Thus, where reference is made herein to a padlock, it should be understood that the locking mechanism may be easily adapted to a wide variety of lock types and styles. The term "shackle" is used herein in its broadest sense as any device to make something fast, including but not limited to any fixed or moveable clevis (U-shaped shackle), pin, bolt, shaft, dog, J-shaped shackle, or the like.

Figure 1:
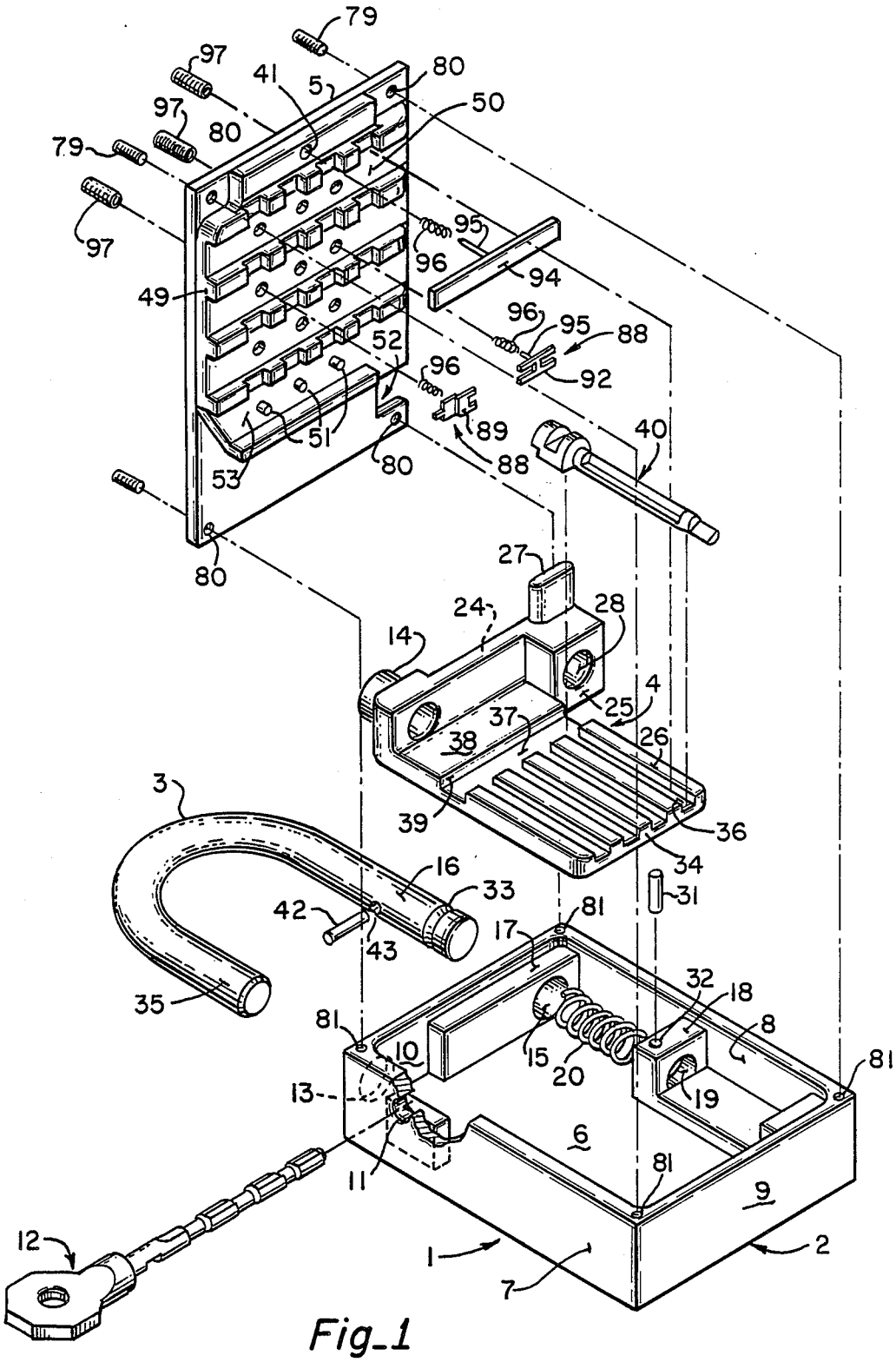
FIG. 1 is an exploded perspective view of the lock in accordance with this invention in a padlock form showing the inter-relationship of the parts.

FIG. 1 shows in exploded perspective view the locking mechanism of this invention adapted to a push-button padlock 1. In this embodiment the invention broadly comprises a lock housing 2, a J-shaped shackle 3, a thumb latch assembly 4, and a face plate 5. The lock housing may be of any general shape, but is preferably generally rectangular and comprises a backplate 6, opposed, spaced apart side walls 7 and 8, a bottom wall 9, and a top wall 10. The walls are upstanding with respect to the backplate. They may be integral with the backplate or secured with any convenient fastening means.

While the push-button padlock is illustrated in FIG. 1 as having 10 buttons, it should be understood that any convenient number of push-buttons may be provided, and an example of a 16 push-button lock (also in padlock form) and a 13 push-button lock (in deadbolt or cabinet lock form) are included in the drawings and detailed description. Generally, the more push-buttons that are provided, the greater number of combinations are available. Accordingly, if a great number of combinations is desired, then the number of push-buttons may be increased.

In addition, the push-buttons are shown arrayed in a three by three matrix (3 push-buttons in a row, forming 3 columns, times three columns) with an additional single push-button located in the fourth row, second column position, but it is understood that the push-buttons may be arrayed in with greater spacing therebetween in the matrix. Likewise, they can be spaced in any type of pattern, such as a single column or row, or a circle, or triangular pattern, or the like.

In FIGS. 19 and 20, buttons 1–3 or 1–5 are called a "row" of buttons, while buttons 1, 4 and 7 or 6 and 11 are called a "column". A convenient formula for a rectangular array of buttons may be expressed as $T=(r \cdot c)+1$; where $T$=total number of buttons, $r$=number of rows and $c$=number of columns which is also the number of buttons in a row). For example, in FIG. 19 where $T=11$, $r=C=3$ and in FIG. 20 where $T=16$, $r=3$, and $c=5$.

In the specific examples of push-button locks shown, that of 10 and 16 button push-button padlocks and the deadbolt/cabinet lock, the side plate 7 of the lock housing 2 has a key hole 11 provided therein through which a master key 12 may be introduced, but it should be understood that a master key is an auxiliary secondary means for opening the padlock, providing a back-up in case of a forgotten combination or for opening the lock by a supervisor or security personnel, e.g. where the padlock is used to lock school lockers.

The top wall 10 has a hole 13 through which the sleeve 14 of the thumb latch assembly 4 reciprocates. Spaced laterally therefrom in top wall 10 and aligned in the same plane as hole 13 is a hole 15 which receives the long (entrained) end 16 of the J-shaped shackle 3. The lock housing 2 is provided with an upper journal block 17, which contains a hole therein which is aligned and a continuation of hole 15 in the top wall 10. The lock housing 2 is also provided with a lower journal block 18 which has a hole 19 that is axially aligned with the hole 15 passing through the top wall 10 and upper journal block 17 of the lock housing. Lower journal block 18 is spaced longitudinally from upper journal block 17, and compression spring 20, which receivingly engages the entrained end 16 of the J-shaped shackle, is disposed between the blocks.

Continuing with FIG. 1, the thumb latch assembly 4 comprises a thumb latch block 25, to which is separately or integrally attached a locking plate 26, a break away thumb latch 27 and a sleeve 14. The thumb latch block also has disposed therein, adjacent one marginal edge, a hole 28, which is axially aligned with holes 15 and 19 to receive the entrained end 16 of the J-shaped shackle. As best seen in FIGS. 2A and 3B, when assembled, the sleeve 14 of the thumb latch assembly 4 is received through hole 13 in the top wall 10 of the housing. The compression spring 20 is disposed on shackle entrained end 16 between the lower face 29 of the thumb latch block and the upper face 30 of the lower journal block 18.

After the entrained end 16 of the shackle 3 is inserted in the journals as described above, shackle pin 31 is screwed or pressfit into hole 32 in the lower journal block 18. As best seen in FIGS. 2A and 3B, the shackle retaining pin engages the shackle groove 33, thus preventing it from being pulled out of the lock. The groove and pin are sized to permit swivel rotation of the shackle without binding, yet the groove is sufficiently deep and the shackle retaining pin of sufficient diameter that the shackle cannot be pulled out of the lock by deforming the shackle retaining pin short of totally destroying the lock. Preferably, both the shackle retaining pin and the surface area of the shackle groove 33 are hardened to improve the strength of the lock. Conveniently, a plastic collar 21 is placed adjacent the top plate 10 to seal the hole 15 therein. This is done most conveniently by slipping it over the short free end 35 of the shackle 3.

As best seen in FIG. 1 the locking plate 26 of the thumb latch assembly 4 has a series of four lower locking rod channels 36 which are conveniently square bottomed channels in cross section, and are coordinately aligned with a series of similar upper locking rod channels 50 on the underside of the faceplate 5. The lower locking rod channels 36 have a first open end at the marginal edge 34 at the bottom of the locking plate 26 and a second open end where the lower locking rod channels 36 perpendicularly intersect the lower locking rod head channel 37. They also are spaced equidistant from each other and parallel to the longitudinal axis of the locking plate 26. The lower locking rod head channel 37 traverses the entire width of the locking plate 26 and is open ended at both margins thereof. It has a depth equal to the depth of the lower locking rod channels 36. The width of the lower locking rod head channel 37 is defined between the perpendicular convergence of the lower locking rod channels 36 and the upper wall 39. The remaining upper surface of the locking plate 38 extends a distance beyond the upper wall 39 of the lower locking rod head channel 37 by the amount necessary to accommodate the vertical reciprocating motion desired for the thumb latch assembly 4.

The face plate 5 has secured to, or integral therewith, a button block 49, which has an array of button holes 22 defining, in this example, a three by three matrix with an additional (tenth) relock button hole 41 located below the matrix aligned with the middle column. Interspersed within the columns of the button holes 22 are a set of four parallel, equally spaced upper locking rod channels 50 and an upper locking rod head channel 53 which are disposed, aligned and coordinate with the above-described lower set of four locking rod channels 36 and the lower locking rod head channel 37 of the locking rod plate 26. A series of spaced key guide pins 51 are secured in intervals along the center longitudinal axis of the upper locking rod head channel 53. As shown, these guide pins protrude a vertical distance into the rod head channel 53 sufficient to engage the circular clearance grooves 72 of the master key 12 (best seen in FIGS. 17, 18, 22 and 23). It should be understood that the key guide pins may be of varied dimensions and spacing in order to provide an infinite number of master key combinations (best seen in Comparing FIGS. 17A and 22).

Figure 21:
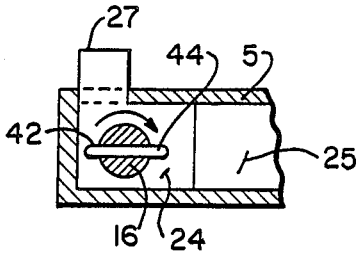
FIG. 21 is a transverse view taken along line 21—21 of FIG. 2B showing the functioning of the pivot lock pin and the groove that receives it.

To assemble a lock, the thumb latch assembly 4 is inserted into the lock housing 2, as above described, with the sleeve 14 passing through the hole 13 in the top wall 10. Thereafter, the spring 20 is positioned as shown in FIG. 1, and the entrained end 16 of the J-shaped shackle is inserted through the holes 15, 28, through the open core of the spring 20 and thence into the hole 19 in the lower journal block 18. The shackle-retaining pin 31 is then press-fit into its receiving hole 32 and the shackle is thus secured into its operating position in the lock. The shackle can then be turned 90 degrees and the pivot lock pin 42 is press fit into hole 43 in the entrained end 16 of the shackle. The functioning of the pivot lock pin 42 is best shown in FIGS. 2A, 2B and 21. This pin 42 and the area in which the hole 43 is positioned is preferably case hardened for lock security.

As best seen in FIG. 21, thumb latch block 25 is provided on its upper face 24 with a groove 44 (preferably hardened) that receives the pivot lock pin 42 when the thumb latch assembly 4 is in its upper, locked position. This prevents opening the lock by rotating the shackle in the event the sleeve 14 is removed by a thief, for example by attempting to saw the sleeve 14 off the thumb block 25. Normally the sleeve 14 is case hardened, just as is the entire shackle; thus sleeve removal is unlikely. But in the event the sleeve 14 is removed, still the shackle cannot pivot because the case-hardened pivot lock pin 42 is trapped in the hardened groove 44 preventing it from turning. This is also seen in FIG. 2A where the pivot lock pin 42 is shown in phantom received in groove 44 in the thumb latch block 25. Then, when the lock is opened by downwardly reciprocating the thumb latch assembly 4, the pin 42 is released from the groove 44 and the shackle can be pivoted. Since there is only one groove on the face 24 of the block 25, the pin 42, extending out beyond the outer margin of the shackle 16, can rest on the upper surface 24 of block 25, thus maintaining the thumb latch in the downward released (unloeked) position. This prevents the lock from locking in the open position.

Continuing with the assembly, the locking rods 40 are placed into the lower locking rod channels 36, after which the face plate 5 containing the button block 49 and the 10 push-button assemblies 90 are then placed over the thumb latch assembly 4. To complete the assembly, one or more pins 79 are press-fit through holes 80 in the face plate 5 and thence into correspondingly aligned bores 81 in the lock housing 2. As an alternative to press fitting, the face plate 5 may be secured by adding appropriate non-removable fastening means, such as one-way screws, headless screws, spot welding, locking bolts, or the like.

The face plate also includes a relieved portion 52, through which the breakaway thumb latch 27 is received, and which aperture is vertically long enough to permit reciprocation of the thumb latch from its upper lock position to its lowered open position.

The operation of the lock mechanism is best shown in FIGS. 2A, 2B, and 8–16. FIGS. 2A and 2B show the lock in front elevation with the face plate 5 and locking rod members 40 removed to show the operation of the thumb latch assembly 4. FIG. 2A shows the thumb latch assembly 4 in its uppermost position which corresponds to the locked position, in which the short, free end 35 of the J-shaped shackle is received in the sleeve 14. Since the shackle retaining pin 31 is in place, the shackle cannot be reciprocated upwardly out of the sleeve 14. The locking rod head members (not shown) provide a blocking means, when any one of the locking rod members is rotated to a locked or relock position, preventing the thumb latch assembly 4 from being downwardly reciprocated to release the shackle from the sleeve 14 (as described in more detail below with respect to FIGS. 8 through 16). Further, the shackle cannot be rotated because the pivot lock pin 42 is received and engages the groove 44 in the upper face 24 of the thumb latch block 25.

FIG. 2B shows the thumb latch assembly being reciprocated downwardly as indicated by arrow A. This is accomplished by thumb pressure on the upper surface of the break-away thumb latch 27 after pushing the correct combination of push-buttons which rotates the locking rods 40 thereby permitting the locking plate 26 to reciprocate downwardly as illustrated by Arrow B. That causes the sleeve 14 to retract through hole 13 into the interior of the lock housing 2. This releases the pin 42 from its groove 44, thus permitting the shackle to pivot about the axis of the entrained end as illustrated by Arrow C in FIG. 2B. The initial position of the shackle after opening is shown by the dotted line in FIG. 2B, and the fully open position is shown in solid lines. Note that there is only minimal clearance between the free end 35 of the shackle 3 and the top face of the top plate 10.

To relock the lock, the shackle is first pivoted back to the position shown in dashed lines in FIG. 2B. Pressure is released from the thumb latch 27 and the spring 20 urges the thumb latch block 25 upwardly, thus bringing the locking plate 26 back to the locked position as shown by Arrow D in FIG. 2A. The push-buttons are spring loaded and are therefore automatically rebound (return) to their neutral (outer) position once the depressing force acting on them is released.

DETAILED DESCRIPTION OF LOCK MECHANISM:

FIGS. 3–7, show the locking rod members. FIG. 3 shows a top view of the locking rod member 40 which comprises a center rod portion 63 disposed between a locking rod head 60 and a locking rod tail 54. The center rod portion 63 is essentially circular in cross section with a V-shaped groove 56 therein. As best illustrated in FIG. 4, the V-groove 56 is a pie slice section spanning an arc of 120 degrees. The locking rods 40 are oriented in the locking rod channels 36 so that the V-grooves 56 of the rods are face up. Depressing the combination push-button assemblies 91, 92 and 93 engages the actuator member (herein also called a base) of the push-button assemblies with a surface of the V-section channels 56, thereby causing the locking rod member to rotate to either a first open, or second locked/relock position (the locked and relock position being mirror images of each other).

An example of a locking rod member and corresponding locking rod head being rotated from a locked position to the open position is represented by comparing the rotational movement of the 1st position locking rod with its locking rod head from a "start" position in FIGS. 8B and 8C to a rotated position as seen in FIGS. 9B and 9C.

As seen in FIGS. 4–7, (particularly FIG. 6), the locking rod head 60 is generally a half-cylinder having a sliding head flat 58 defined by a longitudinal plane (in which the longitudinal axis of the rod lies). A planar key flat 57, disposed spaced from and parallel to the sliding head flat 58, is notched into the top part of the curved surface of the locking rod head half cylinder. An and view of the locking rod head 60, as in FIG. 6, shows two pieslice relieved portions 59 (of approximately 30°), and a chamfered edge 62 defining the arc therebetween. When the padlock is fully assembled and the shackle is in the closed position, as shown in FIG. 2A, the sliding head flat 58 of the locking rod head 60 is positioned in the lower locking head channel 37 of the locking plate 26. The portion of the locking rod head 60 containing the pie-shaped relieved portions 59 overlaps the upper surface 38 of the locking plate 26. After depressing the correct combination of buttons in the proper sequence, the locking rod heads 60 are rotated so that the sliding head flats 58 are parallel to the adjacent upper surface 38 of the locking plate 26, thus allowing sufficient clearance for the reciprocating movement of the locking plate 26 upon actuation of the thumb latch 27.

Stated another way, the upper wall 39 of locking plate 26 butts against shoulder 61 in rod head 60 preventing opening. When the rod is rotated properly (Rod #2 in 8C as compared to Rod #2 in FIG. 9C), the wall 39 no longer abuts shoulder 61 and locking plate upper surface 38 can slide by (or along)flat 58 in the rod. It is a principle of this invention that locking is accomplished by placing arcuate segments of rod members in compression, and unlocking by rotating the arcuate segments out of compressive engagement with a sliding block (thumb latch block). By providing a number of segments, totalling a significant angular percentage of an entire rod, a lock of high strength is achieved. Thus, for example aluminum rod segments totalling a ¼" rod provide compressive resistance against opening of considerably more than the 900 to 1200 lbs. to open typical high strength padlocks. Hardened steel parts or greater total area under compression can give even greater strengths.

This important feature is explained further with reference to FIGS. 5 and 6. The pie-slice radial relieved portions 59 each extend partway along the longitudinal length of the locking rod heads 60 beginning with one end at the top of the locking rod head and terminating in a shoulder 61. Prior to any reciprocating movement of the thumb latch 27 and block 25 each shoulder 61 abuts the upper wall 39 of the lower locking rod head channel 37 and rod head surface 59 rests on or in close proximity to and parallel with block face 38. Upon rotation of the locking rod heads 60 to the unlocked position, there is just sufficient clearance for the shoulder 61 to slidingly clear upper wall 39 and permit the block face 38 to slide on face 58 of rod head 60. Conversely, when an improper sequence of combination push-buttons have been depressed, at least one of the locking rod heads 60 will have been rotated to either the locked or relock position. That is, one of the shoulders 61 of pie-shaped relieved sections 59 will abut wall 39 thereby preventing downward reciprocating movement of the locking plate 26 and opening of the lock.

As best shown in FIG. 1, each push-button assembly 90 comprises a base (or rod actuator) member 88, a button stem 95 perpendicularly attached thereto, a button rebound spring 96, and a button cap 97. The base 88 configurations are different for each of four types of buttons and comprise all the permutations and combinations of a so-called C flange and a T flange. For ease of convention, the buttons are described by the alphabet letters they resemble and are read from left to right. Thus, the combination push-button assembly 90 is provided for in four different types, so-called H actuator 92, C-T actuator 89, T-C actuator 91 (a mirror image of C-T actuator 89), and double T actuator 93 (not pictured in FIG. 1). There is also a single relock button 94, which resets the combination to the relock position by punching only one button (fast relock feature).

FIGS. 8–12, 15 and 16 illustrate the different combination type push-buttons and the functioning of the locking mechanism when these push-buttons are depressed. It is important to note that by combining two base types in a single button assembly, each button can engage two rods. By this feature the push-button locking mechanism of this invention is sequence dependent. For example if the correct combination in a 9 push-button lock (10 PB including relock) is 2–6–7, pressing the buttons in the order 7–6–2 or 6–2–7 or 2–7–6 or 6–7–2 will not open the lock. This is a great advantage over conventional push buttons, e.g. of the Cheng type which are independent of sequence, as this vastly increases the number of possible combinations with fewer buttons. In Cheng, all 6 permutations of 2–7–6 open the lock. In our invention each of the locks has a unique combination sequence.

Figures 11, 11A, 11B, 11C, 12, 12A, 12B, 12C, 13, 13A, 13B, 13C, 14, 14A, 14B, 14C, 15, 15A, 15B, 15C:
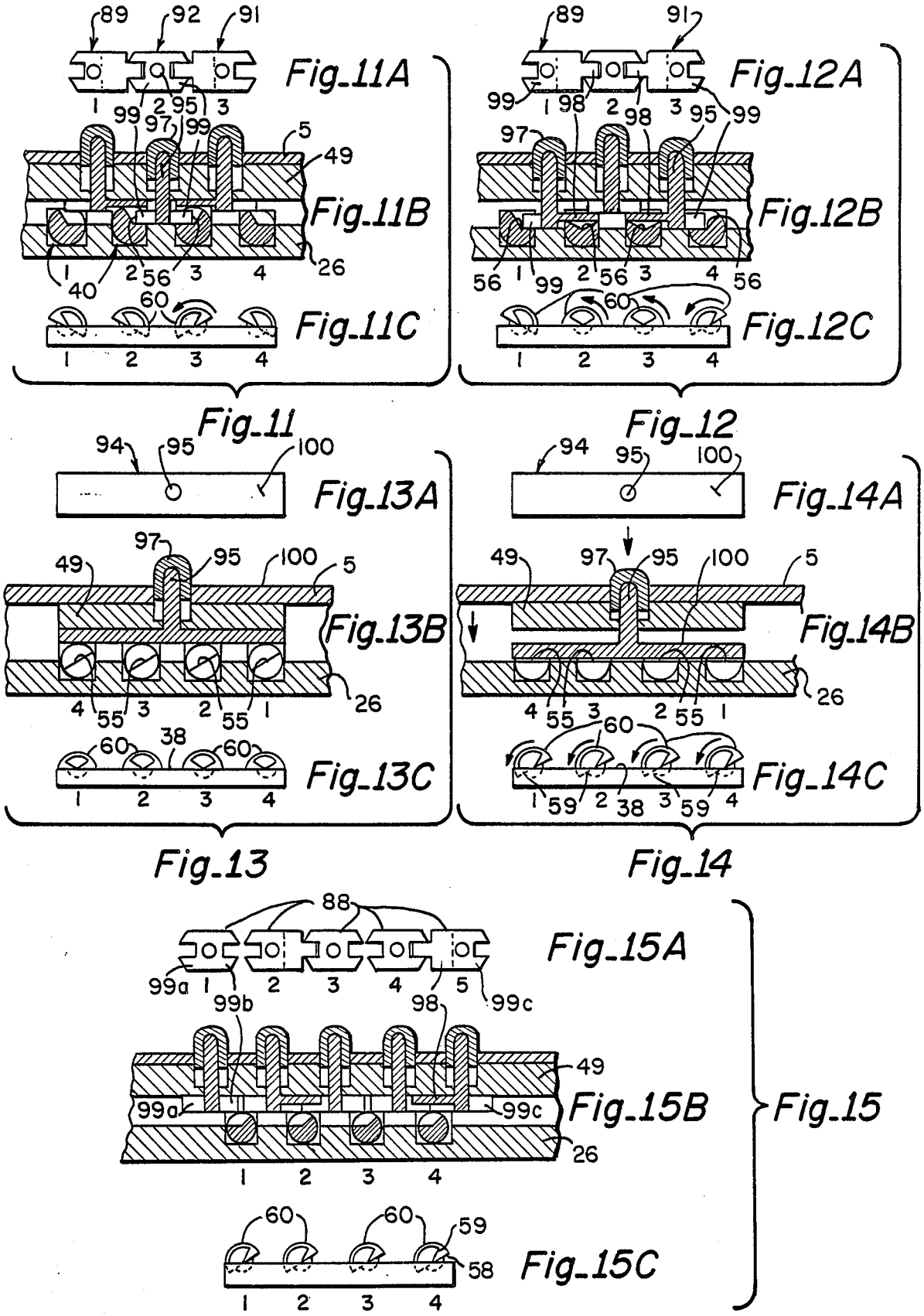

FIGS. 8–12 show a three-part partial cross section view of the 10 button padlock which illustrates the rotation of the center rod portions and corresponding locking rod heads by engagement of the C or T flanges of the various push-button bases (actuators) with the side walls of the V-groove in the center portion of rod 60 upon depressing the push-buttons. The button spring 96 is shown in FIGS. 8B and 9B but is omitted from FIGS. 10B—16B for clarity. FIGS. 8–10 show an arrangement of a T-C actuator 91, double T actuator 93, C-T actuator 89, while FIGS. 11 and 12 show a C-T actuator 89, H actuator 92, and T-C actuator 91 arrangement. In the 3×3 matrix arrangement of combination push-buttons each button affects two rods simultaneously with the C-T actuator 89 and T-C actuator 91 each rotating one locking rod head 60 to the unlocked position and one rod to the locked position. The H actuator also rotates one locking rod head 60 to the locked position and an adjacent locking rod head 60 to the relock position, and the double T actuator rotates two rods to the unlocked position. The number of possible correct push-button combinations is dependent on the number and arrangement of C-T or T-C actuators, double T actuators and the number of rows of actuators employed, so that the use of each double T actuator, by rotating two rods to the unlocked position, reduces the number of depressed buttons required by one.

As best seen in FIG. 8A, the 1st position T-C actuator 91 has a composite base 88 comprising a T-flange 98 (stem of T oriented to the left) joined to a C-flange 99, while the 2nd position double-T actuator 92 comprises a head to head union of two T-flanges 98 with the stems oriented left and right. The 3rd position C-T actuator 89 is mirror image of the 1st position T-C actuator 91. The two types of flanges, T-flange 98 and C-flange 99, are distinctly different in appearance and function. The depth of the flange (or thickness as seen in side elevation, best seen in FIG. 9B), measured from the top surface of the flange to the bottom surface of the flange, and length of the flange (lateral extent) determine the degree of rotation imparted to the locking rods upon depression of the push-buttons. As best seen in FIG. 9B, the C-flange 99 of the depressed 1st position T-C button 91, by having a greater depth and shorter length than the T-flange 98, engages the adjacent side of the V-groove 56 of the locking rod thereby causing a complete 60° rotation of the locking rod head 60 of the 2nd position locking rod member to the locked position (Compare FIG. 8C, to FIG. 9C). Hereafter, the locked position is defined as the maximum permitted (complete) clockwise rotation of the locking rod head as seen in the positions of all four rods in FIG. 8C, while the relock position is the complete 60° counterclockwise rotation of the locking rod head as viewed from the same perspective, e.g. rod 2 in FIG. 9C. But it is understood that these two positions could be reversed depending on which way the canted end relock flat 55 slant, since it is the actuation of the relock button assembly 97, causing the relock bar 94 to engage the canted end relock flats 55, that results in a rotation of the locking rod heads to the relock position. Where the canted end relock flat 55 slants downwardly to the left (as seen in FIG. 7), the relock position and the locked position would be reversed, and the new locked position would be defined as the complete counterclockwise rotation of the locking rod head and the relock position would be defined as the complete clockwise rotation of the locking rod head.

Conversely, the T-flange 98, having a longer length but shallower depth causes a rotation just sufficient to set the locking rod head 60 in the unlocked position; see the #1 position locking rod member in FIG. 9C.

As best seen in FIG. 9C, rod #1, the T flange 98 is long enough to contact both ridges 45 and 46 of the V groove 56 permitting only 30° or so rotation. Upon depressing 1st position push-button assembly 91, the T flange 98 first contacts ridge 46 and rotates it counterclockwise. Then ridge 45 contacts flange 98 and the rotation stops in the unlocked position. Thus, only T-flange buttons are "correct" combination buttons. Where a C button is in another row, say behind the button 91 (FIGS. 8–12) and can act on the #1 rod, if button 91 is pressed and the rod #1 is unlocked, then if the C button in the next row is pushed, the rod is again locked. Thus, pushing buttons in the correct sequence is required. Conversely however, if non-sequence dependence is desired, only T and dummy actuators (actuators with a stem 95 and no C or T flange(s)) can be used, the T-flange actuators for the combination and dummies for all other buttons.

The functioning of a depressed double T actuator is best illustrated in FIG. 10, wherein the T-flanges 98 of the 2nd position push-button (shown in cross section in 10B) have engaged the ridges 45, 46 of the V-groove 56 of the 2nd and 3rd position locking rod members, causing rotation of the 2nd and 3rd position locking rod heads (see FIG. 10C) to the unlocked position.

The H actuator 92 is a union of two C flanges 99 and imparts a rotation to the locking rod members it engages to the locked or relock positions. This is best illustrated in FIG. 11 where the left C-flange 99 of the 2nd position H button 92 has engaged the right wall of the V-groove 56 of the 2nd position locking rod member 40 and imparted a rotation to the 2nd position locking rod head 60 to the locked position (FIG. 11C, rod #2), while the right C-flange 99 of the 2nd position H actuator 92 has engaged the left wall of the V-groove 56 of the 3rd position locking rod member and imparted a rotation to the 3rd position locking rod head 60 to the relock position (FIG. 11C, rod #3).

FIG. 12 illustrates how the orientation of all four locking rod members may be affected by the depression of the 1st and 3rd position push-buttons. In this example, the depressed 1st position C-T actuator 89 acts on the 1st and 2nd position locking rod members. Using FIG. 8C as a reference point for the initial position of the locking rod heads 60, the 1st position locking rod head 60 in FIG. 12C is unaffected by the engagement of the right wall of its V-groove 56 with the left C-flange 99 (see FIG. 12B) of the C-T actuator 89 since it is already in the locked position. The 2nd position locking rod head 60 is rotated counterclockwise approximately 30° to the unlocked position. This is a result of engagement of the T-flange 98 with both ridges of the V-groove 56 (see FIG. 12B). FIGS. 12B and 12C show how the C-flange 99 of the 3rd position T-C actuator 91 engages the left Wall of the V-groove 56 of the 4th position locking rod member and how it imparts a rotation counter-clockwise to the 4th position locking rod head to the relock position.

In summary, only the T-flange 98 functions to rotate a locking rod member 30° into the unlocked position, while the C-flange 99 functions to rotate a locking rod member 60° to either the locked or relock position depending on which side wall of the V-groove 56 it engages. Therefore, T-C actuator 91 and C-T actuator 89, both comprising a T-flange 98 and a C-flange 99, function to set one locking rod member to the unlocked position and one locking rod member to the locked position. Similarly, double T actuator 93 is a double-acting unlocking actuator, and H actuator 92, comprising two C-flanges 99, is a double-acting locking actuator.

It should be understood that the locking rod member may be incrementally rotated by multiple button actuation of one or more flanges into a locking or unlocking position. While 30° rotation into an unlocked, and 60° rotation into a locked or relock position is shown in the specific examples, the pie-slice relieved portion and V-groove angles need not be 30° and 120° respectively, but may be more or less than that. Also, by selectively varying the lateral extent and thickness of a flange i.e. a C-flange 99, rotations of less than 60° (but not equal to 30°, since this would function as a T-flange) can be achieved. Thus, a sequence dependent depression of two or more actuators each having preselected thicknesses of C-flanges will incrementally rotate the locking rod member affected until the sum of the angular rotational increments adds up to that angle necessary to position it in the unlocked position. The selectively varied thickness C-flanges, still function as locking or relocking flanges, when individually engaged to rotate a locking rod member by an insufficient or too great amount, or when severally engaged to a single locking rod member in an incorrect sequence to under- or over-rotate the locking rod member. Thus, more combinations and greater sequence dependence is possible with fewer buttons, e.g. as many combinations (or none) are possible with a 10 PB incrementing flange locking mechanism as with a 16 PB non-incrementing arrangement.

It should also be understood that the flanges are not limited to "T" configurations. For example the lateral extending member of a T flange may extend from the upper or lower meridian of the actuator base forming an L-flange. Likewise, since it is unnecessary for the C-flange to have 2 laterally extending members, it can also be modified to resemble a truncated "L" or 7-flange.

Thus, the actuator combinations would be identified "7L", "L7", "double L" and "double 7" actuators. However, as with C and T flanges consideration must be given to the placement in a row to insure no interference of adjacent flanges.

FIGS. 15 and 16 show in a three-part partial cross section view, an alternate five push-button row arrangement for a 16 push-button combination padlock. Note how the 1st and 5th position push-buttons (the outermost push-buttons), i.e. the left most double C and right most T-C actuator, affect only the 1st and 4th position locking rods respectively (the outermost locking rods). This 16 push-button configuration offers a greater number of possible combinations than the 10 push-button configuration. While the left most actuator is shown as a double C actuator comprising C flanges 99*a* and 99*b*, the C flange 99*a* may be omitted from the #5 position button. Conversely, 6 rods, providing greater strength and more combinations, could be used by adding a rod on the outside of rod numbers 1 and 4, so that the C flanges 99*a*, 99*c* contact them. In at least one other row of buttons, a T-C or double T flange would be on button #1, and a double T or C-T flange on button #5 to open those rods.

As seen in FIGS. 13 and 14, the base (or actuator) of the relock button 94 is a simple rectangular bar having a length, width and depth sufficient to engage all of the canted end relock flats 55 upon depression of the relock button. Once the proper sequence of combination buttons have been pressed, the canted end relock flats 55 and the locking rod heads 60 assume the orientation shown in FIGS. 13B and 13C respectively. It is at this point that the thumb latch assembly can be actuated and the lock opened. After closing the shackle, the operator simply depresses the relock button 94, which engages the canted end relock flats 55 and rotates them to a horizontal orientation (see FIG. 14B), and correspondingly rotates the locking rod heads 60 to the relock position (see FIG. 14C). FIG. 14C shows all four locking rod heads 60 rotated counterclockwise with the left sided pie-slice relieved portions 59 resting on the upper surface 38 of the locking plate 26.

The assembly and functioning of the push buttons are best illustrated upon examination of the 1st position T-C actuator 91 of FIGS. 10A and 10B. The push-buttons have an automatic return (rebound) action by virtue of the spring 96 and are easily assembled into the button block 49 by inserting the button stem 95 through the button hole 22 in the outward direction so that the button stem 95 protrudes from the outer surface face plate 5. The button spring 96 (omitted for clarity in FIG. 10B), which occupies the annular space created between the button stem 95 and button hole 23, is then placed over the protruding button stem 95 followed by the button cap 97 that is press fit onto the end of the button stem. The button hole 23 extends through the face plate 5 and a substantial depth into the button block 49. The smaller stem hole 22 in the lower portion of the button block 49 is axially aligned with and a continuation of button hole 23. It is a smaller diameter than hole 23, being just sufficient to receive the button stem 95 there through and provide a shoulder 48 defining a stop against which the button spring 96 can work. The diameter of the button hole 23 is just sufficient to permit movement of the button cap 97 without wobbling or scratching. The button spring 96 is confined between the bottom surface of the button cap 97 and the shoulder 48. As best seen in FIGS. 8 and 9, the "throw", that is the up and down (in and out) travel of the buttons in the lock housing is determined by the relative depth of the face plate holes 23 and the stacking height of the compressed button springs 96. FIG. 8B shows a cross section view of three push-buttons in a undepressed position with the button springs 96 in a relaxed state. FIG. 9B shows a T-C button being depressed to fully compress the button spring 96 height.

Turning now to FIGS. 19 and 20, the button holes 23 are conveniently numbered consecutively from left to right, top to bottom starting with the top left button hole. In the 10 pushbutton combination shown in FIG. 19, where 4 rods are used, a 4–6–2 combination may be provided for by inserting a T-C button in hole 4, a C-T button in hole 6, and a double T button in hole 2. Note that the depression of buttons is partially sequence-dependent in a 4-rod lock, as the locking rod heads would also be rotated to the unlocked position for a 6–4–2 combination. But it is required that the number 2 double T button to be depressed last in this sequence, as it will rotate the 2 center rods simultaneously to the unlocked position. The subsequent depression of any other buttons with a C-flange oriented towards hitting either of the center 2 rods thereafter would further rotate the affected center rod to a second locked or relock position. This can be changed to a 2 button combination by having a double T button in the left column of holes 1, 4, or 7 and in the right column of holes 3, 6, or 9, and depressing both double T buttons only.

In addition, a greater number of buttons may be depressed and the lock successfully opened, but this would require a redundancy of like T-flanges acting on the same locking rod, and affect sequence dependence. FIG. 20 shows an alternate button hole configuration for increasing the complexity of the total number of possible combinations and permutations. As mentioned above, the buttons in the 1st and 5th column positions (buttons 1,6 and 11, and buttons 5, 10 and 15, respectively) only affect the locking rods of the 1st and 4th rod positions respectively, and not two locking rods at once as do the buttons in the center three columns (columns 2, 3 and 4). Thus a possible combination of 7, 9, 3 that consists of a T-C button in hole 7, a C-T button in hole 9, and a double T button in hole 3 would move all the locking rods to the unlocked position as would a 6, 10, 3 that has a C-T button in hole 6, a T-C button in hole 10 and a double T button in hole 3.

OPTIONAL AUXILIARY MASTER KEY AND OPERATION:

FIG. 18 shows the special features of the auxiliary master key 12. As best seen in FIG. 18A and 18B, the key shaft 75 is generally cylindrical except for having a key guide flat 74 (see FIGS. 18B, 18C and 18E), which is a flat surface running substantially the length of the shaft, the width of which defines a chord length preferably less than the diameter of the cylinder. Transverse to the key shaft are located three spaced-apart circular clearance grooves 77 that follow the curved section of the shaft. It must be understood that these circular clearance grooves need not be identical in width, or spaced at regular intervals, as varying these parameters affords a greater number of possible combinational configurations for the master key. The pin guide (longitudinal clearance groove) 72 is disposed longitudinally along the key shaft 75, intersects the circular clearance grooves 77, and extends from the free end of the shaft to some convenient distance beyond the third circular clearance groove 77*c*. The longitudinal clearance groove 72 and the circular clearance groove 77 are equally recessed portions of the key shaft 75. The longitudinal clearance groove functions as a longitudinal clearance guide for insertion of the master key 12 into the padlock housing. The circular clearance grooves 77 function as a circular clearance guide for rotation of the master key once the master key is properly inserted.

The shoulder 73 acts as a stop and prevents over-insertion of the key shaft 75 into the housing. The key also has a key head 78 for easy manipulation by the operator's thumb and fingers and a hole 71 for a key ring.

As best seen in FIG. 18C, the key shaft 75 has a notched cut relieved portion defining a cam stop 76 along one side adjacent the shoulder end of the key guide flat 74. The cam stop 76 prevents over rotation of the key within the padlock housing as is further described below. FIG. 18F is a cross section view showing the cam stop 76 oriented at a right angle to the key guide flat 74 with a corner edge therebetween. FIG. 18E is another cross section view taken along line 18E—18E of FIG. 18C which shows the longitudinal clearance groove 72, the circular clearance groove 77, the key shaft 75, and the key guide flat 74.

The functioning of the circular clearance groove 77, longitudinal clearance groove 72, the cam stop 76 and the shoulder 73 of the master key 12 is best shown in FIG. 17. FIG. 17A is a partial transverse cross section view of the lock housing taken along line 17A—17A in FIG. 2A showing all four locking rod heads 60 in the relock position interspersed by the guide pins 51*a*, 51*b* and 51*c* extending vertically downward from the underside of the face plate 5. Along the tops of the locking rod heads 60 are the key flats 57 which act as a caming surface to the cylindrical portion of the key shaft 75 upon rotation of the key.

In operation, the key is inserted through a keyhole 11 in the side wall 7 of the padlock housing with the longitudinal clearance groove 72 vertically upward in order for the guide pins 51 to guide the key shaft straight in the lock housing. The material removed from the key shaft 75 leaving exposed a face defined by the key guide flat 74 is sufficient to permit insertion of the key without interference of the locking rod heads 60 by the key guide flat 74. Upon complete insertion of the key, the circular clearance grooves 77*a*, 77*b* and 77*c* of the key shaft 75 are aligned with the guide pins 51*a*, 51*b*, 51*c* and the shoulder 73 abuts against the side wall 7. This is best illustrated in FIG. 17B. Clockwise rotation of the key simultaneously rotates all locking rod heads 60 to the unlocked position by a caming action between the curved portion of the key shaft 75 and the key flats 57 of the locking rod heads 60. The key is prevented from further rotation by the cam stop 76.

As best seen in FIG. 17C, the keyhole 11 in the side wall 7 has attached thereto a key journal block 70. This is also visible behind the partially broken away side wall 7 in the area of the key hole 11 of FIG. 1. The keyhole 11 extends through the key journal block 70 except for a remaining bottom portion of the hole where the extra material defines a horizontal chord and the arc it spans. It is along the surface of this chord where the cam stop 76 of the key shaft is engaged and prevented from further rotation. The length of the chord defining the key guide flat 74 is sufficiently less than the length of the chord defining the cam stop 76 so that the key shaft 75 can rotate in the hole 11 in the key journal block 70 without interference of the corner edge created by the intersection of the key guide flat 74 and the cam stop 76.

Figure 22:
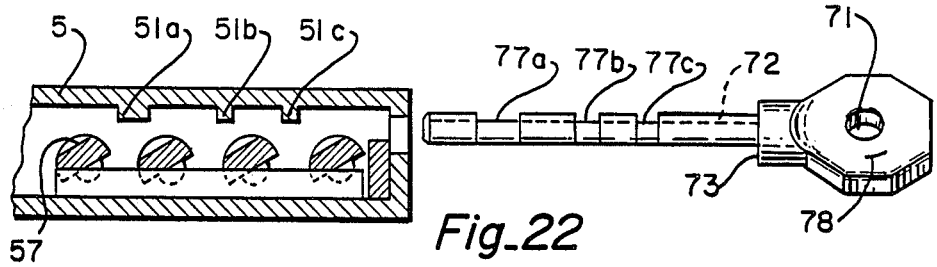
FIG. 22 is a transverse section view of the lock housing taken along line 22—22 of FIG. 2A with the addition of the master key showing an alternate, random spaced configuration for the guide pins and corresponding circular clearance grooves.
Figure 23:
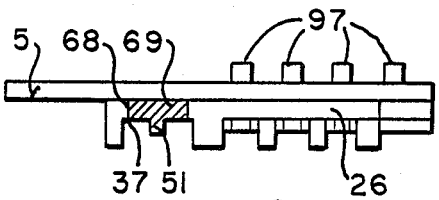
FIG. 23 is a side elevation view of the face plate showing an alternate configuration for an insertable guide pin block.

An alternate combination configuration for a master key is shown in FIG. 22, where the width and spacing of the circular clearance grooves 77*a*, 77*b*, 77*c* have been changed. Likewise, the corresponding dimensions and spacing of the guide pins 51*a*, 55*b*, 55*c* along the underside of the face plate 5 have been changed. As best shown in FIG. 23, an insertable guide pin block 69 carrying one or more pins 51*a*, 51*b* and/or 51*c* can be press fit into a block channel 68, thereby simplifying manufacturing so that uniquely individual face plates need not be made. In addition, the insertable guide pin block 69 permits changing a master key combination or providing for replacement in case of damaged pin guides due to misuse or abuse.

Figure 24:
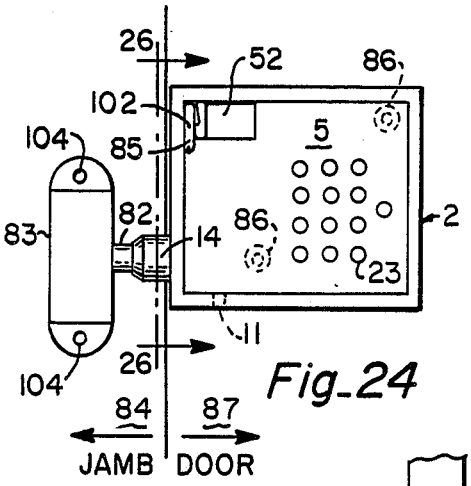
FIG. 24 is a front elevation view of an alternate embodiment of the lock of this invention in the form of a dead bolt or cabinet type lock secured to a door with the fixed bolt secured to the jam or cabinet frame.
Figure 25:
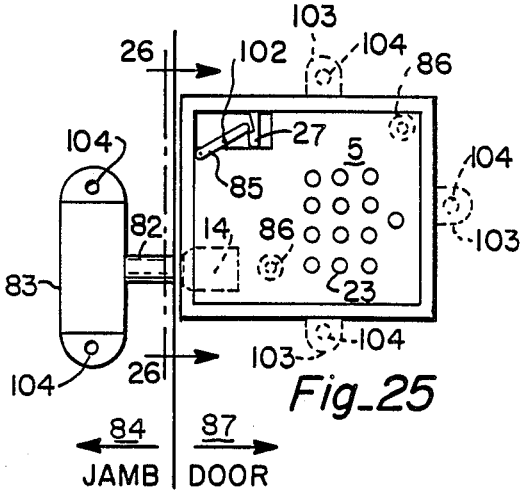
FIG. 25 is the identical front elevation view as in FIG. 24 showing the dead bolt embodiment in the unlocked position (shackle sleeve retracted)
Figure 26:
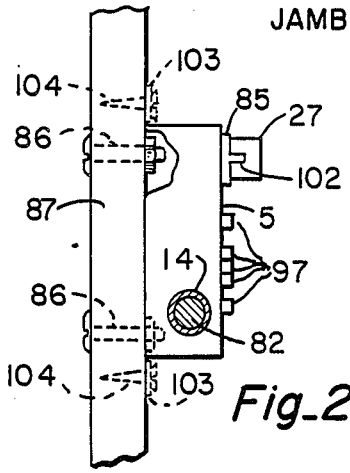
FIG. 26 is a side elevation view of a door/or cabinet mounted push-button lock taken along line 26—26 of FIGS. 24 and 25.

FIGS. 24–26 show as an alternate embodiment, the lock mechanism of this invention in a deadbolt or cabinet lock application. In FIG. 24 a fixed dead bolt 82 is secured to a retainer block 83 which is secured to a door jamb 85 by fasteners 104. The lock housing 2 is mounted onto the door 87 with the sleeve 14 axially aligned with the fixed dead bolt 82 by securing the back plate of the lock housing to the door by one or more securing screws 104 or 86 (shown in phantom in FIGS. 24–26). Where the deadbolt lock is mounted on the inside of the door the mounting tab 103 and screws 104 may be used (shown in phantom in FIG. 25) where the deadbolt is mounted on the outside of a door, the hidden screws 86 are used. In both cases one-way screws may be used.

The unlocking operation of the dead bolt push-button lock is identical to that of the padlock except that the J-shaped shackle is replaced by the fixed dead bolt 82 and dead bolt retainer block 83. The correct sequence of buttons must first be depressed before the thumb latch 27 can be actuated thereby reciprocating the sleeve 14 into the lock housing 2. This is shown in FIG. 25 where the sleeve 14 (represented in dashed lines) has been fully retracted into the lock housing.

A pawl 85 has been added to the door mounted push-button lock embodiment in order to conveniently hold the latching assembly in the open position without the need for continued thumb pressure on the thumb latch 27. Recall that in the push-button padlock embodiment (see FIGS. 2A, 2B) a pivot lock pin 42 is provided to hold the thumb latch block 25, along with the attached sleeve 14 thereto, in the downwardly reciprocated, open position. Since that is not provided in this embodiment, upon actuation of the thumb latch 27, the pawl 85 is rotated into position as shown in FIG. 25 to retain the thumb latch in the fully reciprocated position whereby the sleeve 14 is retracted from the fixed dead bolt and the door 87 is permitted to swing open. The pawl 85 rests in the pawl notch 101. To relock, the door is shut re-aligning the sleeve 14 with the fixed dead bolt 82, the pawl 85 is lifted from the notch 101 by the pawl retract knob 102 to release the thumb latch 27 thereby causing the sleeve 14 to reciprocatingly engage the fixed dead bolt 82. The pawl 85 is pivotally secured to the face of the lock housing, but it should be understood that the pawl or other thumb latch retaining mechanism could be disposed internally in the lock housing as part of the thumb latch assembly by means of a rachet, ball detent, or other convenient retaining mechanism.

FIG. 26 shows the lock housing mounting scheme, whereby nuts or threaded holes for receiving the securing screws 86 are provided in the inside back plate 6 of the lock housing 2. This provides for hidden attachment particularly for external mounting of the lock, but it should be understood that external attachments such as tab 103 and screws 104 are also possible. Likewise, the lock can be inset in the door so the button faceplate 5 is flush with the outside of the door and the shackle 82 and block 83 are either embedded in the door or are on the inside of the door. The shackle 82 and sleeve 14 may be reversed.

Small 4, 7 or 10 button versions of this lock arrangement are particularly suitable for use in medicine cabinets to child-proof them, where either the door or casing carries the lock and the casing or door, repetitively carries the retainer block and dead bolt. This would add a significant margin of safety to often deadly medicine cabinets where it is impractical for the user to have a key on his or her person, e.g. after stepping out of the shower or getting up from bed.

It should be understood that various modifications within the scope of this invention can be made by one of ordinary skill in the art without departing from the spirit thereof. For example, the push-button locking mechanism disclosed herein may be used with a variety of shackle and shackle latch types, such as reciprocating shackles, and a variety of housing types and shapes, such as round, square, cubic, rectangular, etc. Conversely the pivot-only shackle and/or reciprocating thumb latch assembly with sleeve may be used alone or in combination with a wide variety of locking mechanisms such as rotary dial locks, cylinder dial (brief case type) locks, key locks, or other push-button configurations. We therefore wish our invention to be defined by the scope of the appended claims as broadly as the prior art will permit, and in view of the specification if need be.

We claim:

1. An improved lock mechanism for engaging a shackle-type securing member actuatable from a first locked mode to a second unlocked mode by actuation means comprising in operative combination:

(a) a plurality of generally elongated cylindrical locking members each having a longitudinal axis;

(b) means for retaining said locking members with their longitudinal axes in generally parallel spaced relationship;

(c) means for selectively engaging a shackle member in a first locked mode and releasing it in a second unlocked mode;

(d) means for blocking said selective shackle locking-/unlocking means from releasing said shackle, said blocking means being mounted in association with at least one of said locking members;

(e) at least one means for selectively rotating at least one of said locking members into a first rotated position so that said blocking means is selectively oriented to permit said shackle locking/unlocking means to release said shackle so that said lock may be opened; and (f) a plurality of means for actuating said selective rotation means to permit said blocking means to release said shackle upon activating only selected ones of said actuation means and define at least one lock-opening combination.

2. A lock mechanism as in claim 1 wherein said selective rotating means includes at least one means for selectively rotating at least one of said locking members into at least one second rotated position so that said blocking means is selectively oriented to prevent said shackle unlocking/locking means from releasing said shackle and to retain said lock in said locked mode.

3. A lock mechanism as in claim 2 wherein said means for selective rotation of said locking members includes said first and said second locking member rotated position means in association with a single one of said actuation means so that at least one of said lock combinations is sequence dependent.

4. A lock mechanism as in claim 3 which includes means for simultaneously rotating all of said locking members into at least one second position so that said blocking means is selectively oriented to prevent said shackle unlocking/locking means from releasing said shackle and to retain said lock in said locked mode.

5. A lock mechanism as in claim 2 which includes means for simultaneously rotating all of said locking members into at least one second position so that said blocking means is selectively oriented to prevent said shackle unlocking/locking means from releasing said shackle and to retain said lock in said locked mode.

6. A lock mechanism as in claim 1 which includes means for simultaneously rotating all of said locking members into at least one second position so that said blocking means is selectively oriented to prevent said shackle unlocking/locking means from releasing said shackle and to retain said lock in said locked mode.

7. A lock mechanism as in claim 1 wherein:

(a) said locking member includes a V-groove disposed medially thereof oriented with the bottom of said groove parallel to the longitudinal axis of said locking member and with the upper edges intersecting the periphery of said locking member to define a pair of generally parallel spaced ridges; and (b) said selective rotating means includes at least one laterally extending member defining a flange which contacts at least one of said ridges.

8. A lock mechanism as in claim 2 wherein:

(a) said locking member includes a V-groove disposed medially thereof oriented with the bottom of said groove parallel to the longitudinal axis of said looking member and with the upper edges intersecting the periphery of said locking member to define a pair of generally parallel spaced ridges; and (b) said selective rotating means includes at least one laterally extending member defining a flange which contacts at least one of said ridges.

9. A lock mechanism as in claim 8 which includes:

(a) a plurality of said flanges disposed with at least one flange associated with each of a plurality of actuation means; and wherein:

(b) at least one of said flanges is adapted to contact both of said ridges to rotate at least one of said locking members to said first rotated position;

(c) at least one of said flanges is adapted to contact only one of said ridges to rotate at least one of said locking members to said second rotated position.

10. A lock mechanism as in claim 9 wherein:

(a) at least two flanges are disposed in association with at least one of said actuation means; and (b) at least two locking members are disposed adjacent each other and spaced to permit said flanges to contact at least one of said ridges on each of said locking members.

11. A lock mechanism as in claim 10 wherein:

(a) a first of said two flanges contacts both of said ridges on one of said locking members; and (b) a second of said flanges contacts one of said ridges on the other of said locking members.

12. A lock mechanism as in claim 10 wherein one both of said flanges contacts both of said ridges on one of said locking members and the other of said flanges contacts both of said ridges on the other of said locking members.

13. A lock mechanism as in claim 8 wherein said flange is adapted to contact both of said ridges on one of said locking members.

14. A lock mechanism as in claim 13 wherein:
(a) at least two flanges are disposed in association with at least one of said actuation means; and
(b) at least two locking members are disposed adjacent each other and spaced to permit said flanges to contact at least one of said ridges on each of said locking members.

15. A lock mechanism as in claim 13 which includes means for simultaneously rotating all of said locking members into at least one second position so that said blocking means is selectively oriented to prevent said shackle unlocking/locking means from releasing said shackle and to retain said lock in said locked mode.

16. A lock mechanism as in claim 14 wherein:
(a) a first of said two flanges contacts both of said ridges on one of said locking members; and
(b) a second of said flanges contacts one of said ridges on the other of said locking members.

17. A lock mechanism as in claim 14 wherein one of said flanges contacts both of said ridges on one of said locking members and the other of said flanges contacts both of said ridges on the other of said locking members.

18. A lock mechanism as in claim 16 which includes means for simultaneously rotating all of said locking members into at least one second position so that said blocking means is selectively oriented to prevent said shackle unlocking/locking means from releasing said shackle and to retain said lock in said locked mode.

19. A lock mechanism as in claim 17 which includes means for simultaneously rotating all of said locking members into at least one second position so that said blocking means is selectively oriented to prevent said shackle unlocking/locking means from releasing said shackle and to retain said lock in said locked mode.

20. A lock mechanism as in claim 2 wherein:
(a) at least two flanges are disposed in association with at least one of said actuation means; and
(b) at least two locking members are disposed adjacent each other and spaced to permit said flanges to contact at least one of said ridges on each of said locking members.

21. A lock mechanism as in claim 20 wherein:
(a) a first of said two flanges contacts both of said ridges on one of said locking members; and
(b) a second of said flanges contacts one of said ridges on the other of said locking members.

22. A lock mechanism as in claim 20 wherein one of said flanges contacts both of said ridges on one of said locking members and the other of said flanges contacts both of said ridges on the other of said locking members.

23. A lock mechanism as in claim 20 wherein one of said flanges contacts only one ridge on one of said locking members, and the other of said flanges contacts only one ridge on the other of said locking members.

24. A lock mechanism as in claim 7 which includes:
(a) a plurality of said flanges disposed with at least one flange associated with each of a plurality of said actuation means; and wherein:
(b) at least one of said flanges is adapted to contact both of said ridges to rotate at least one of said locking members to said first rotated position;
(c) at least one of said flanges is adapted to contact only one of said ridges to rotate at least one of said locking members to said second rotated position.

25. A lock mechanism as in claim 24 wherein:
(a) at least two flanges are disposed in association with at least one of said actuation means; and
(b) at least two locking members are disposed adjacent each other and spaced to permit said flanges to contact at least one of said ridges on each of said locking members.

26. A lock mechanism as in claim 25 wherein:
(a) a first of said two flanges contacts both of said ridges on one of said locking members; and
(b) a second of said flanges contacts one of said ridges on the other of said locking members.

27. A lock mechanism as in claim 25 wherein one of said flanges contacts both of said ridges on one of said locking members and the other of said flanges contacts both of said ridges on the other of said locking members.

28. A lock mechanism as in claim 1 wherein said plurality of actuation means are push-buttons disposed in a spaced array of at least one push-button between adjacent said locking members.

29. A lock mechanism as in claim 28 wherein:
(a) said plurality of locking members are selected from an array of from two to six; and
(b) said plurality of push-buttons are selected from an array of from three to twenty-nine.

30. A lock mechanism as in claim 29 wherein said lock mechanism has 9 or 10 push-buttons and 3 to 4 locking members.

31. A lock mechanism as in claim 29 wherein said locking mechanism has 15 or 16 push-buttons and three to four locking members.

32. A lock mechanism as in claim 2 wherein said plurality of actuation means are push-buttons disposed in a spaced array of at least one push-button between adjacent said locking members.

33. A lock mechanism as in claim 32 wherein:
(a) said plurality of locking members are selected from an array of from two to six; and
(b) said plurality of push-buttons are selected from an array of from three to twenty-nine.

34. A lock mechanism as in claim 7 wherein said plurality of actuation means are push-buttons disposed in a spaced array of at least one push-button between adjacent said locking members.

35. A lock mechanism as in claim 34 wherein:
(a) said plurality of locking members are selected from an array of from two to six; and
(b) said plurality of push-buttons are selected from an array of from three to twenty-nine.

36. A lock mechanism as in claim 12 wherein said plurality of actuation means are push-buttons disposed in a spaced array of at least one push-button between adjacent said locking members.

37. A lock mechanism as in claim 36 wherein:
(a) said plurality of locking members are selected from an array of from two to six; and
(b) said plurality of push-buttons are selected from an array of from three to twenty-nine.

38. A lock mechanism as in claim 18 wherein said plurality of actuation means are push-buttons disposed in a spaced array of at least one push-button between adjacent said locking members.

39. A lock mechanism as in claim 38 wherein:

(a) said plurality of locking members are selected from an array of from two to six; and
(b) said plurality of push-buttons are selected from an array of from three to twenty-nine.

40. A lock mechanism as in claim 19 wherein said plurality of actuation means are push-buttons disposed in a spaced array of at least one push-button between adjacent said locking members.

41. A lock mechanism as in claim 40 wherein:
(a) said plurality of locking members are selected from an array of from two to six; and
(b) said plurality of push-buttons are selected from an array of from three to twenty-nine.

42. A lock mechanism as in claim 7 wherein:
(a) said actuation means comprises a stem secured to said flange;
(b) a button member associated with said stem; and
(c) said button being spring biased for automatic return to an initial up position, after pressure causing said button to be depressed is released.

43. A lock mechanism as in claim 11 wherein:
(a) said actuation means comprises a stem secured to said flange;
(b) a button member associated with said stem; and
(c) said button being spring biased for automatic return to an initial up position, after pressure causing said button to be depressed is released.

44. A lock mechanism as in claim 12 wherein:
(a) said actuation means assembly comprises a stem secured to said flange;
(b) a button member associated with said stem; and
(c) said button being spring biased for automatic return to an initial up position, after pressure causing said button to be depressed is released.

45. A lock mechanism as in claim 18 wherein:
(a) said actuation means assembly comprises a stem secured to said flange;
(b) a button member associated with said stem; and
(c) said button being spring biased for automatic return to an initial up position, after pressure causing said button to be depressed is released.

46. A lock mechanism as in claim 19 wherein:
(a) said actuation means assembly comprises a stem secured to said flange;
(b) a button member associated with said stem; and
(c) said button being spring biased for automatic return to an initial up position, after pressure causing said button to be depressed is released.

47. A lock mechanism as in claim 26 wherein:
(a) said actuation means assembly comprises a stem secured to said flange;
(b) a button member associated with said stem; and
(c) said button being spring biased for automatic return to an initial up position, after pressure causing said button to be depressed is released.

48. A lock mechanism as in claim 28 wherein:
(a) said actuation means assembly comprises a stem secured to said flange;
(b) a button member associated with said stem; and
(c) said button being spring biased for automatic return to an initial up position, after pressure causing said button to be depressed is released.

49. A padlock having a first locked mode and a second unlocked mode, comprising in operative combination;
(a) a housing having a front face, a back face spaced from said front face, and at least one wall disposed between said faces to form a perimeter wall of said housing, said faces and said wall defining a volume in said housing, said perimeter wall having at least a first hole and a second hole therethrough;
(b) a shackle formed in a generally inverted J-shape, having a generally cylindrical first entrained portion and a second free end portion, said first and said second portions being joined by an intermediate portion;
(i) said shackle being disposed with said first entrained portion mounted through said perimeter wall first hole into said housing volume to only rotate at least partially around the longitudinal axis of said first cylindrical entrained portion,
(ii) said intermediate portion, and said free end portion being disposed external of said housing in both said locked and said unlocked modes;
(c) a reciprocating latching assembly having means for receivingly engaging said free end portion of said shackle external of said perimeter wall;
(i) said latching assembly being disposed mounted in said housing with said shackle free end engaging means reciprocatingly movable in said second hole in said perimeter wall;
(d) means for selectively locking said latching assembly to prevent pivoting release of said shackle free end portion from said reciprocating receivingly engaging means, and to provide said first locked mode and said second unlocked mode, so that upon selective release of said latching assembly said latching assembly may be reciprocatingly actuated to release externally of said perimeter wall said shackle free end and permit pivoting only of said shackle by at least partial rotation of said shackle around said entrained cylindrical axis thereof; and
(e) said means for selectively locking said latching assembly comprises in operative combination;
(i) a plurality of generally elongated cylindrical locking members each having a longitudinal axis;
(ii) means for retaining said locking members with their longitudinal axes in generally parallel spaced relationship;
(iii) means for selectively engaging a shackle member in a first locked mode and releasing it in a second unlocked mode;
(iv) means for blocking said selective shackle locking/unlocking means from releasing said shackle, said blocking means being mounted in association with at least one of said locking members;
(v) at least one means for selectively rotating at least one of said locking members into a first rotated position so that said blocking means is selectively oriented to permit said shackle locking/unlocking means to release said shackle so that said lock may be opened; and
(vi) a plurality of means for actuating said selective rotation means to permit said blocking means to release said shackle upon activating only selected ones of said actuation means and define at least one lock-opening combination.

50. A push-button padlock comprising:
(a) a housing having a plurality of holes for receiving push-buttons and a single enlarged hole disposed in at least one face of said housing;
(b) a plurality of push-buttons disposed to reciprocate through said push-button holes in said face of said housing;

(c) a manual actuating means which includes a thumb latch member disposed to project through said enlarged hole in said face of said housing, and which is adapted to permit said thumb latch to break away;

(d) a shackle-type securing member having a first entrained end and a second free end, and which includes:

(i) a pivot lock pin mounted in said shackle-type securing member to project from the surface thereof adjacent said shackle-type securing member first entrained end; and (ii) a relieved portion defining a slot in said securing member disposed to receive said shackle pivot lock pin to prevent said shackle from swiveling by engagement of said pin in said slot;

(e) an annular groove disposed in said shackle member entrained end;

(f) a shackle retaining pin secured to said housing and disposed to engage said shackle member groove to permit said shackle to pivot only and to prevent said shackle from being withdrawn from said housing;

(g) means for engaging said shackle member free end which includes a hardened sleeve having an annular cross section with an inner diameter sufficient to receive said shackle free end with minimum tolerance;

(h) a lock mechanism comprising in operative (i) a plurality of generally elongated cylindrical locking members selected from two to six each having a longitudinal axis, wherein each of said locking members has a V-groove disposed medially thereof oriented with the bottom of said groove parallel to said longitudinal axis and with the upper edges intersecting the periphery of each of said locking members to define a pair of generally parallel spaced ridges;

(ii) means for retaining said locking members with their longitudinal axes in generally parallel spaced relationship;

(iii) means for selectively engaging a shackle member in a first locked mode and releasing it in a second unlocked mode, said selective shackle locking/unlocking means being prevented from releasing said shackle by a blocking means, said blocking means being mounted in association with at least one of said locking members;

(iv) means for simultaneously rotating all of said locking members into at least one second position so that said blocking means is selectively oriented to prevent said shackle unlocking/locking means from releasing said shackle-type securing member and to retain said lock in said locked mode, said selective rotating means includes at least one laterally extending member defining a flange which contacts at least one of said ridges;

(v) at least one means for selectively rotating at least one of said locking members into a first rotated position so that said blocking means is selectively oriented to permit said shackle locking/unlocking means to release said shackle so that said lock may be opened; and (vi) a plurality of push-button actuators associated with said plurality of push-buttons disposed to actuate said selective rotation means to permit said blocking means to release said shackle upon depressing only selected ones of said push-buttons and define at least one lock-opening combination, said plurality of push-buttons selected from three to twenty-nine being disposed in a spaced array of at least one push-button between adjacent said locking members, each of said push-buttons being spring biased for automatic return to an initial up position after pressure causing said button to be depressed is released comprises a stem secured to said flange, and a button member associated with said stem.

51. A push-button dead bolt type lock comprising:

(a) a shackle member adapted to be secured to a first member of an object to be locked;

(b) a locking mechanism adapted to be secured to a second, cooperating member of an object to be locked comprising in operative combination:

(i) a plurality of generally elongated cylindrical locking members each having a longitudinal axis;

(ii) means for retaining said locking members with their longitudinal axes in generally parallel spaced relationship;

(iii) means for selectively engaging a shackle member in a first locked mode and releasing it in a second unlocked mode;

(iv) means for blocking said selective shackle locking/unlocking means from releasing said shackle, said blocking means being mounted in association with at least one of said locking members;

(v) at least one means for selectively rotating at least one of said locking members into a first rotated position so that said blocking means is selectively oriented to permit said shackle locking/unlocking means to release said shackle so that said lock may be opened;

(vi) a plurality of means for actuating said selective rotation means to permit said blocking means to release said shackle upon actuating only selected ones of said actuation means and define at least one lock-opening combination; and (c) said shackle and said locking mechanism being adapted to be cooperatively aligned so that said locking mechanism selectively locks and unlocks said shackle so said object may be locked and unlocked by actuation of said selected combination.

52. A dead bolt type lock as in claim 51 which includes means for maintaining said shackle locking/unlocking means in said shackle release position.

53. A lock mechanism as in claim 10 wherein one of said flanges contacts only on ridge on one of said locking members, and the other of said flanges contacts only one ridge on the other of said locking members.

54. A lock mechanism as in claim 14 wherein one of said flanges contacts only on ridge on one of said locking members, and the other of said flanges contacts only one ridge on the other of said locking members.

* * * * *

UNITED STATES PATENT AND TRADEMARK OFFICE

CERTIFICATE OF CORRECTION

PATENT NO. : 4,866,958

DATED : September 19, 1989

INVENTOR(S) : Robert J. Bretl & Jewell A. Taylor

It is certified that error appears in the above-identified patent and that said Letters Patent is hereby corrected as shown below:

Column 6, line 2 is 11B—11B 11B to read --11B-11B--.
Should be -- 11-B -- 11-B --;
Column 7, line 25 is "17A is a is a"
Should be -- 17A is a --;
Column 9, line 20 is "4 and 7 or 6 and"
Should be -- 4 and 7 or 1, 6 and --;
Column 9, line 66 & 67 is "thumb latch block and"
Should be -- thumb latch block 25, and --;
Column 12, line 64 is "An and view"
Should be -- An end view;
Column 12, line 66 is "pieslice"
Should be -- pie-slice --; and
Claim 8-Column 22, line 35 is "looking"
Should be -- locking --.

Signed and Sealed this

Fifteenth Day of January, 1991

*Attest:*

HARRY F. MANBECK, JR.

*Attesting Officer*

*Commissioner of Patents and Trademarks*